US007452312B2

(12) United States Patent
Liu

(10) Patent No.: US 7,452,312 B2
(45) Date of Patent: Nov. 18, 2008

(54) ADJUSTABLE DUMBBELL SYSTEM

(76) Inventor: Ping Liu, No. 8 Oianvingfang Street, Taiyuan, Shanxi (CN)

( * ) Notice: Subject to any disclaimer, the term of this patent is extended or adjusted under 35 U.S.C. 154(b) by 0 days.

(21) Appl. No.: 11/900,852

(22) Filed: Sep. 13, 2007

(65) Prior Publication Data

US 2008/0026921 A1 Jan. 31, 2008

Related U.S. Application Data

(63) Continuation-in-part of application No. 11/494,248, filed on Jul. 27, 2006, now Pat. No. 7,285,078.

(51) Int. Cl.
*A63B 21/072* (2006.01)
*A63B 21/075* (2006.01)

(52) U.S. Cl. ..... 482/108; 482/106

(58) Field of Classification Search ..... 482/106–108; D21/679–682

See application file for complete search history.

(56) References Cited

U.S. PATENT DOCUMENTS 3,771,785 A * 11/1973 Speyer ..... 482/106
7,121,988 B2 * 10/2006 Walkerdine ..... 482/106
7,137,931 B2 * 11/2006 Liu ..... 482/107
7,261,678 B2 * 8/2007 Crawford et al. ..... 482/107
7,285,078 B1 * 10/2007 Liu et al. ..... 482/108
7,291,098 B1 * 11/2007 Krull ..... 482/107
2007/0161474 A1 * 7/2007 Lippitt ..... 482/106

* cited by examiner

*Primary Examiner*—Fenn C. Mathew
*Assistant Examiner*—Allana Lewin

(57) ABSTRACT

A plurality of weights is provided. Each weight has a central primary aperture and primary slot. Each weight has a major section and an axially offset secondary minor section. The minor section is formed with a secondary aperture and a secondary slot. A weight-lifting shaft has a plurality of cam plates. An adjustment knob is provided at each end of the shaft. Each cam plate is an irregularly shaped polygon with radially enlarged sections. In this manner cam surfaces are provided at maximum radii greater than the radii of the remainder of the cam plate. The radially enlarged sections are adapted to releasably couple selectively with the secondary aperture of the weights.

8 Claims, 6 Drawing Sheets

20
30
18
28
34

14
24
26
16

22
32

24
26
34

ADJUSTABLE DUMBBELL SYSTEM

RELATED APPLICATION

The present application is a continuation-in-part of U.S. patent application Ser. No. 11/494,248 filed Jul. 27, 2006 now U.S. Pat. No. 7,285,078, the subject matter of which is incorporated herein by reference.

BACKGROUND OF THE INVENTION

Field of the Invention

The present invention relates to an adjustable dumbbell system and more particularly pertains to being adapted to be self-locked when in use and adjustable when in storage, all in a safe, convenient and economical manner.

SUMMARY OF THE INVENTION

In view of the foregoing disadvantages inherent in the known types of weight systems of known designs and configurations now present in the prior art, the present invention provides an improved adjustable dumbbell system. As such, the general purpose of the present invention, which will be described subsequently in greater detail, is to provide a new and improved adjustable dumbbell system and method which has all the advantages of the prior art and none of the disadvantages.

To attain this, the present invention essentially comprises an adjustable dumbbell system. First provided is a plurality of weights of varying sizes. Each weight has a periphery. The periphery has a top edge and a bottom edge. Each weight has a central primary aperture and primary slot. Each primary slot has one end passing downwardly to the central aperture. Each primary slot has another end extending upwardly to the top edge of the weight. The periphery has a gap. The width of each primary slot is equal to the diameter of the central hole. Each weight has a major section. Each weight has an axially offset secondary minor section. The minor section has a secondary aperture on one side. The minor section has a secondary slot. The secondary slot extends to the secondary aperture. Each secondary aperture has a diameter. The diameter is larger than the diameter of the central aperture. The secondary aperture has a radius. For the majority of its extent, the radius is between 30 and 50 percent of the radius of the majority of the extent of the weight. Each secondary slot has a lower end. The lower end passes downwardly to the secondary aperture. Each secondary slot has an upper end. The upper end extends upwardly to the top edge of the weight. A secondary gap is provided. The width of the secondary slot adjacent to the lower end is less than the diameter of the secondary aperture but larger than the diameter of the central primary aperture. Each minor section also includes an inverted V-shaped recess. The recess is provided below the secondary aperture. The recess extends to the bottom edge.

A weight-lifting shaft is provided. The shaft has center and opposed ends. The center has a grip handle. The center has a rotatable spindle. The spindle extends through the grip handle. A plurality of cam plates are provided. An adjustment knob is provided. The adjustment knob is provided at each end of the spindle. An inner cover is provided. The inner cover is provided adjacent to each plurality of cam plates opposite to the adjustment knob. A bridge shaped plate is provided. The plate is provided over the top of the cam plates. The plate is connected to the inner cover. The plate is hooked on to the adjustment knob. Each cam plate is an irregularly shaped polygon. Each cam plate has radially enlarged sections. The radially enlarged sections provided cam surfaces at maximum radii greater than the radii of the remainder of the cam plate. The radius of the maximum radius of the cam plates is between 5 and 10 percent greater than the radius of the remainder of the cam plate. The radially enlarged sections are adapted to releasably couple selectively with the secondary aperture of the weights. The spindle is adapted to fit through the primary slot. The spindle is further adapted to couple with the central primary aperture of the weight.

Provided next is a holder. The holder has a top and a bottom. The holder has sides. The holder has hand grooves. In this manner safer and more convenient transportation is provided. The holder also has spaced parallel plates. In this manner the weights may be received there between. The inverted V-shaped projections are adapted to receive the V-shaped recesses of the secondary sections.

Further provided is a safety locking assembly. The safety locking assembly allows a user to turn the adjustment knob when the weight-lifting shaft is properly placed on the holder. The safety locking assembly further precludes allowing the adjustment knob to turn when the weight-lifting shaft is lifted from the holder.

The safety locking assembly includes a circular safety locking plate. The safety locking plate is provided within the inner cover of the weight-lifting shaft. The safety locking plate is connected to the rotating spindle of the weight-lifting shaft. The safety locking plate has a plurality of lateral pegs. The pegs are spaced at a equal distance from each other. The pegs are provided around the perimeter of the safety locking plate. Spaces are provided between the pegs. The safety locking assembly also includes a pin. An associated spring is provided. Each spring is adapted to urge the pin downwardly. The pin is mounted to a lower portion of each inner cover. Each pin has a horizontal protrusion. The spaces between the lateral pegs of the safety locking plate are adapted to lock the adjustment knob when the weight-lifting shaft is lifted.

Provided last are platform blocks. The platform blocks are provided on the holder. A hook is provided. The hook is co-operable with the pins of the inner cover of the weight-lifting shaft. The hook is adapted to push the pins up when the weight-lifting shaft is properly placed on the holder. In this manner the adjustment knob is allowed to rotate freely.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adjustable dumbbell system which has all of the advantages of the prior art weight systems of known designs and configurations and none of the disadvantages.

It is another object of the present invention to provide a new and improved adjustable dumbbell system which may be easily and efficiently manufactured and marketed.

It is further object of the present invention to provide a new and improved adjustable dumbbell system which is of durable and reliable constructions.

An even further object of the present invention is to provide a new and improved adjustable dumbbell system which is susceptible of a low cost of manufacture with regard to both materials and labor, and which accordingly is then susceptible of low prices of sale to the consuming public, thereby making such adjustable dumbbell system economically available to the buying public.

Even still another object of the present invention is to provide an adjustable dumbbell system for being adapted to be self-locked when in use and adjustable when in storage, all in a safe, convenient and economical manner.

Lastly, it is an object of the present invention to provide a new and improved adjustable dumbbell system. A plurality of weights is provided. Each weight has a central primary aperture and primary slot. Each weight has a major section and an axially offset secondary minor section. The minor section is formed with a secondary aperture and a secondary slot. A weight-lifting shaft has a plurality of cam plates. An adjustment knob is provided at each end of the shaft. Each cam plate is an irregularly shaped polygon with radially enlarged sections. In this manner cam surfaces are provided at maximum radii greater than the radii of the remainder of the cam plate. The radially enlarged sections are adapted to releasably couple selectively with the secondary aperture of the weights.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the primary and preferred embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
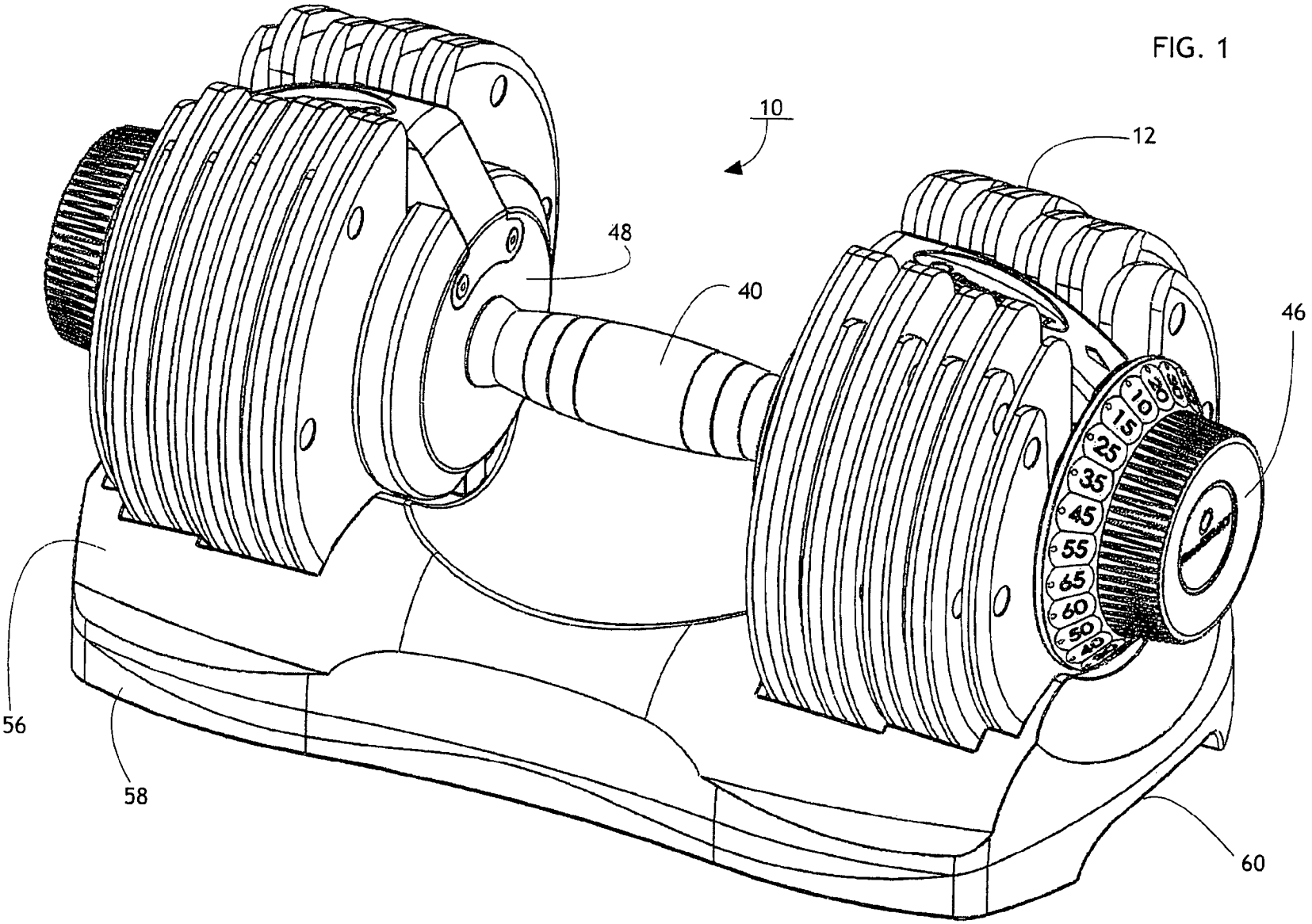
FIG. 1 is a perspective illustration of an adjustable dumbbell system constructed in accordance with the principles of the present invention.
Figures 2, 3, 4, 5:
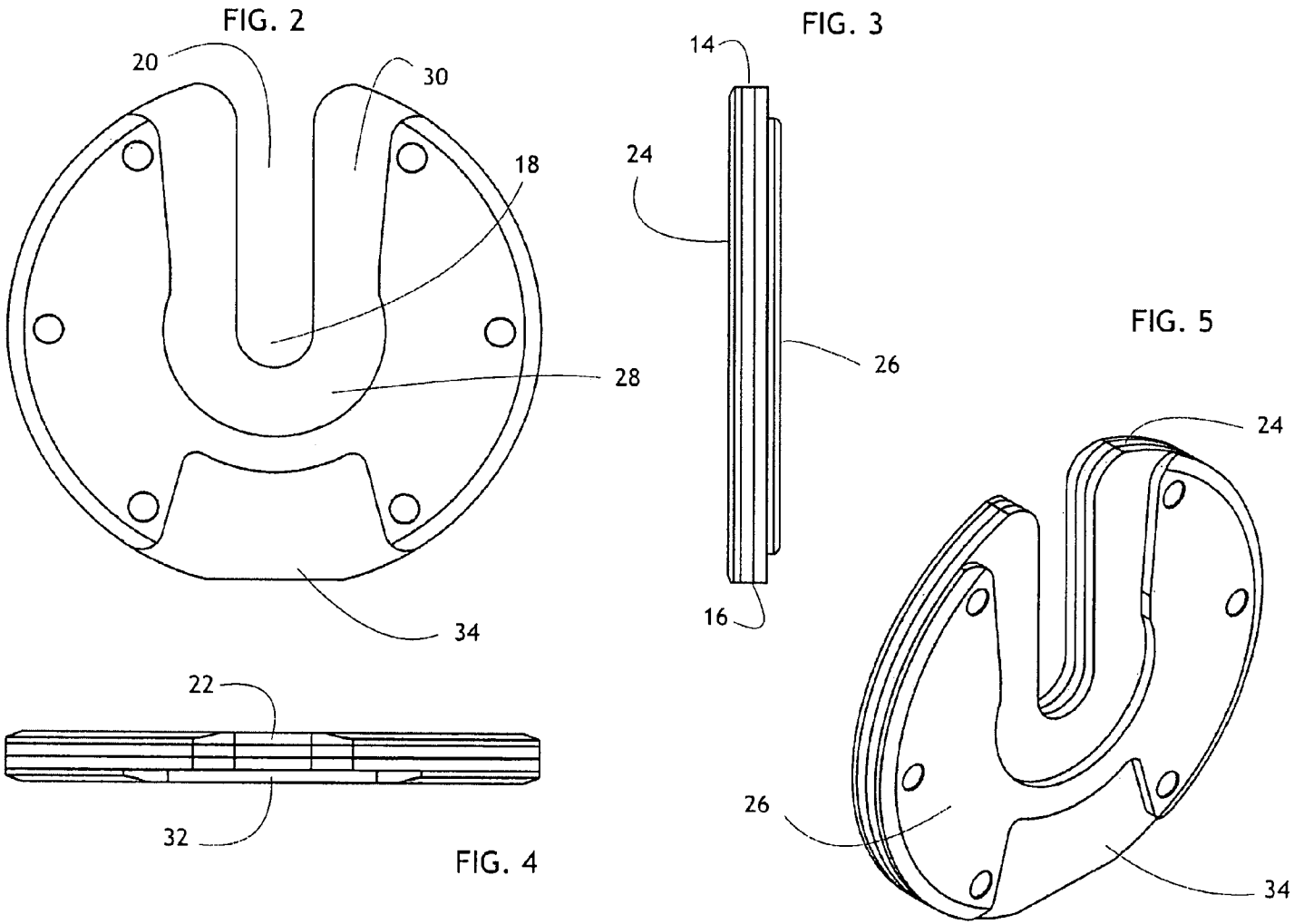
FIG. 2 is a front elevational view of one weight illustrated in FIG. 1.
FIG. 3 is a side elevational view of the weight illustrated in FIG. 2.
FIG. 4 is a plan view of the weight illustrated in FIGS. 2 and 3.
FIG. 5 is a perspective view of the weight illustrated in FIGS. 2, 3 and 4.
Figure 6:
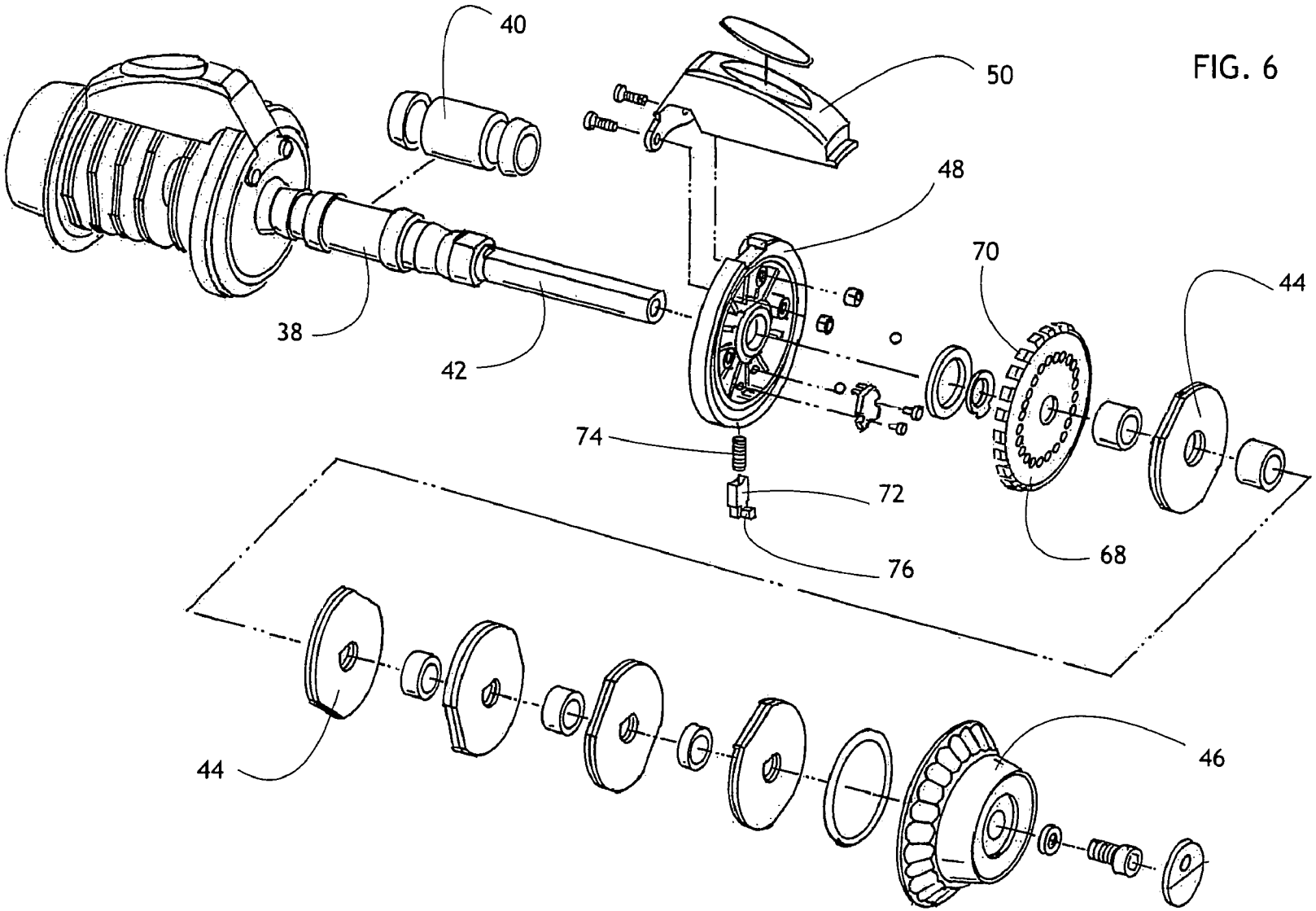
FIG. 6 is an exploded perspective view of the system illustrated in FIG. 1 but remover from the holder.
Figure 8:
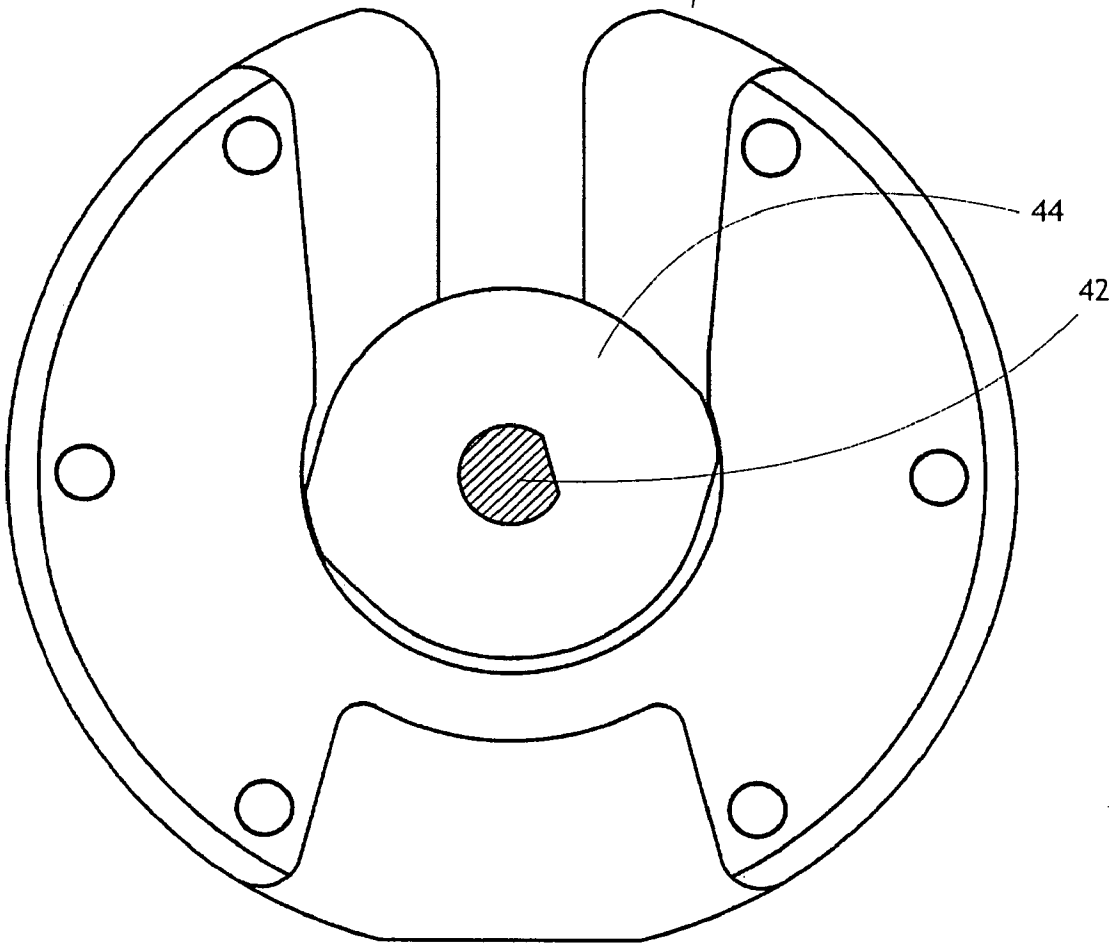
FIG. 8 is a front elevational view of one cam plate and an associated weight as illustrated in FIG. 6.
Figure 7:
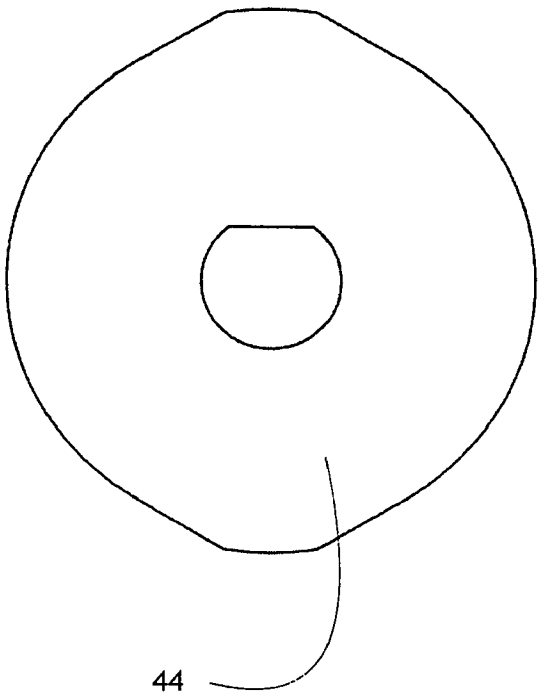
FIG. 7 is a front elevational view of one cam plate as illustrated in FIG. 6.
Figure 9:
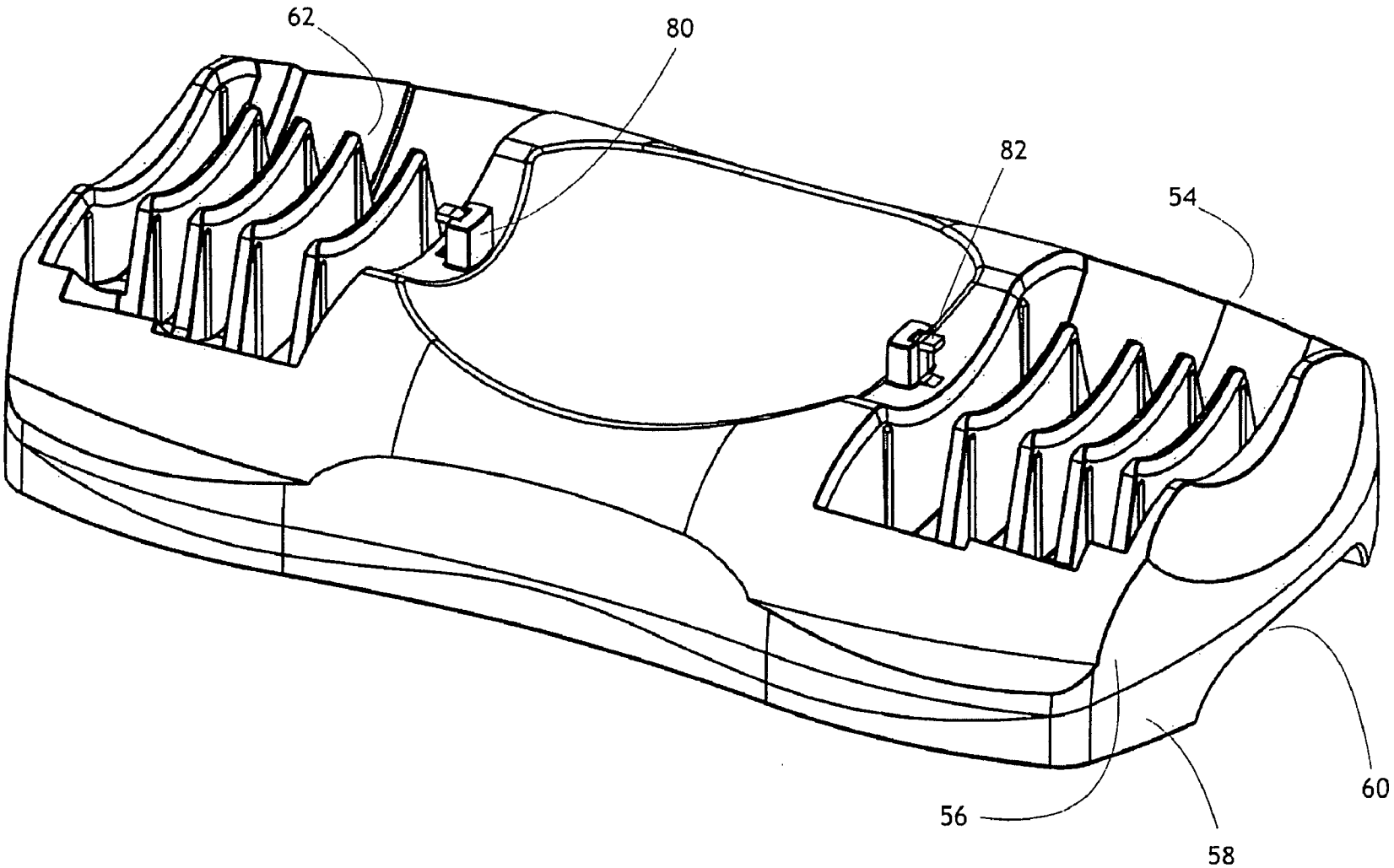
FIG. 9 is a perspective view of the holder illustrated in FIG. 1.
Figure 11:
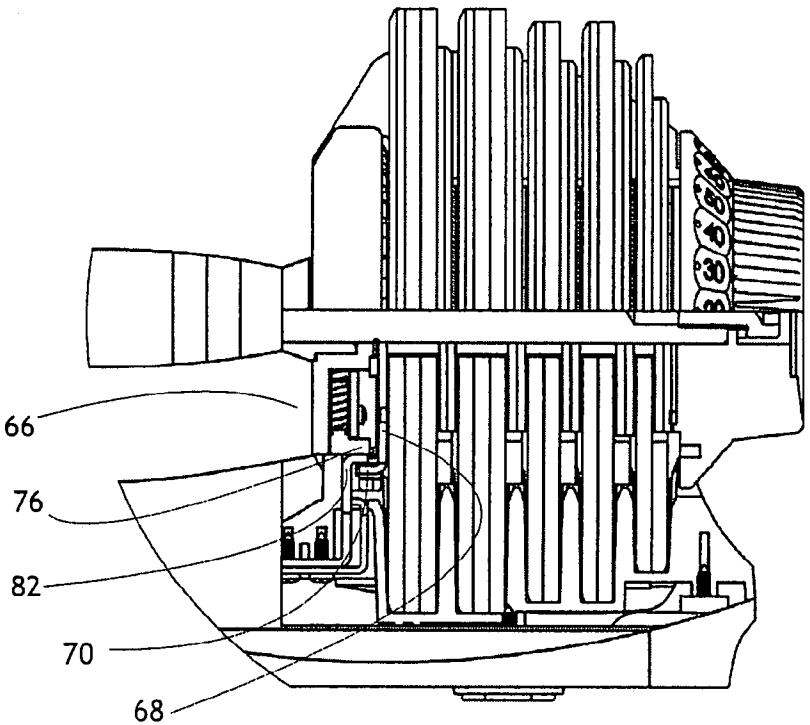
FIG. 11 is a side elevational view of the components illustrated in FIG. 10 with the components coupled.
Figure 10:
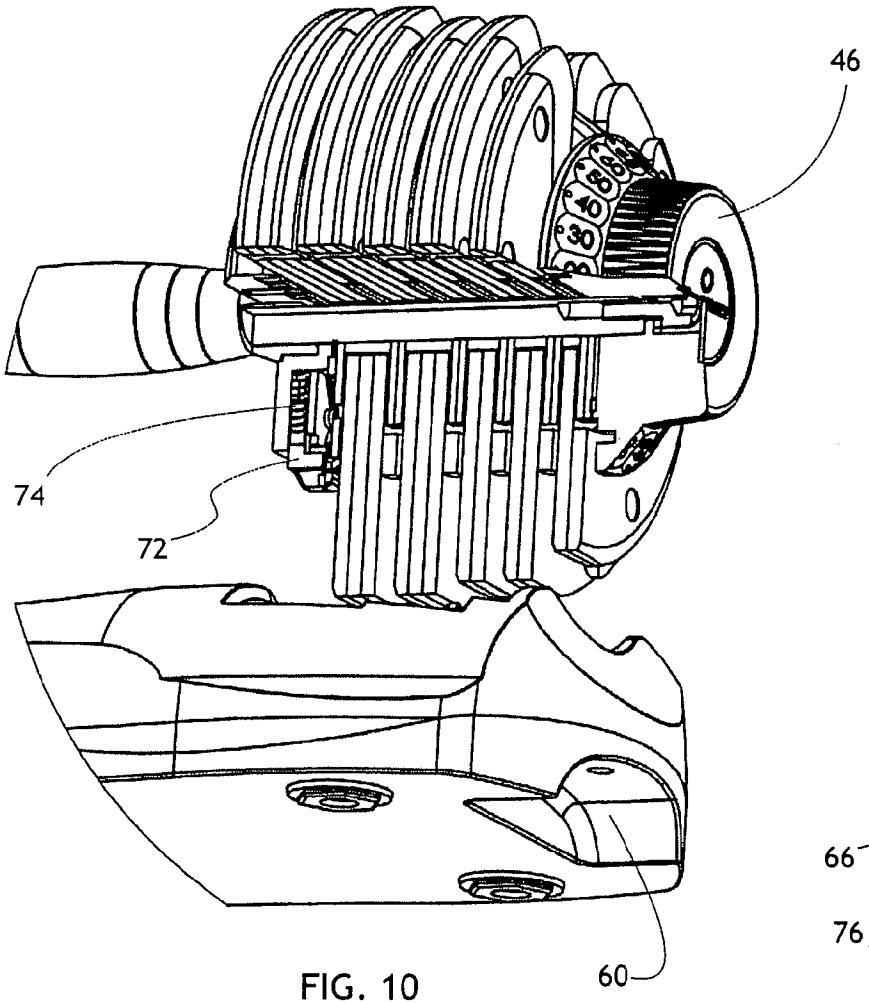
FIG. 10 is a perspective view, partly in section, of the components illustrated in FIG. 1 with the components separated.

With reference now to the drawings, and in particular to FIG. 1 thereof, the preferred embodiment of the new and improved adjustable dumbbell system embodying the principles and concepts of the present invention and generally designated by the reference numeral 10 will be described.

The present invention, the adjustable dumbbell system 10 is comprised of a plurality of components. Such components in their broadest context include a plurality of weights and a weight-lifting shaft. Such components are individually configured and correlated with respect to each other so as to attain the desired objective.

First provided is a plurality of weights 12 of varying sizes. Each weight has a periphery. The periphery has a top edge 14 and a bottom edge 16. Each weight has a central primary aperture 18 and primary slot 20. Each primary slot has one end passing downwardly to the central aperture. Each primary slot has another end extending upwardly to the top edge of the weight. The periphery has a gap 22. The width of each primary slot is equal to the diameter of the central hole. Each weight has a major section 24. Each weight has an axially offset secondary minor section 26. The minor section has a secondary aperture 28 on one side. The minor section has a secondary slot 30. The secondary slot extends to the secondary aperture. Each secondary aperture has a diameter. The diameter is larger than the diameter of the central aperture. The secondary aperture has a radius. For the majority of its extent, the radius is between 30 and 50 percent of the radius of the majority of the extent of the weight. Each secondary slot has a lower end. The lower end passes downwardly to the secondary aperture. Each secondary slot has an upper end. The upper end extends upwardly to the top edge of the weight. A secondary gap 32 is provided. The width of the secondary slot adjacent to the lower end is less than the diameter of the secondary aperture but larger than the diameter of the central primary aperture. Each minor section also includes an inverted V-shaped recess 34. The recess is provided below the secondary aperture. The recess extends to the bottom edge.

A weight-lifting shaft 38 is provided. The shaft has center and opposed ends. The center has a grip handle 40. The center has a rotatable spindle 42. The spindle extends through the grip handle. A plurality of cam plates 44 are provided. An adjustment knob 46 is provided. The adjustment knob is provided at each end of the spindle. An inner cover 48 is provided. The inner cover is provided adjacent to each plurality of cam plates opposite to the adjustment knob. A bridge shaped plate 50 is provided. The plate is provided over the top of the cam plates. The plate is connected to the inner cover. The plate is hooked on to the adjustment knob. Each cam plate is an irregularly shaped polygon. Each cam plate has radially enlarged sections. The radially enlarged sections provided cam surfaces at maximum radii greater than the radii of the remainder of the cam plate. The radius of the maximum radius of the cam plates is between 5 and 10 percent greater than the radius of the remainder of the cam plate. The radially enlarged sections are adapted to releasably couple selectively with the secondary aperture of the weights. The spindle is adapted to fit through the primary slot. The spindle is further adapted to couple with the central primary aperture of the weight.

Provided next is a holder 52. The holder has a top 54 and a bottom 56. The holder has sides 58. The holder has hand grooves 60. In this manner safer and more convenient transportation is provided. The holder also has spaced parallel plates 62. In this manner the weights may be received there between. The inverted V-shaped projections are adapted to receive the V-shaped recesses of the secondary sections.

Further provided is a safety locking assembly 66. The safety locking assembly allows a user to turn the adjustment knob when the weight-lifting shaft is properly placed on the holder. The safety locking assembly further precludes allowing the adjustment knob to turn when the weight-lifting shaft is lifted from the holder.

The safety locking assembly includes a circular safety locking plate 68. The safety locking plate is provided within the inner cover of the weight-lifting shaft. The safety locking plate is connected to the rotating spindle of the weight-lifting shaft. The safety locking plate has a plurality of lateral pegs 70. The pegs are spaced at a equal distance from each other. The pegs are provided around the perimeter of the safety locking plate. Spaces are provided between the pegs. The safety locking assembly also includes a pin 72. An associated spring 74 is provided. Each spring is adapted to urge the pin downwardly. The pin is mounted to a lower portion of each inner cover. Each pin has a horizontal protrusion 76. The spaces between the lateral pegs of the safety locking plate are adapted to lock the adjustment knob when the weight-lifting shaft is lifted.

Provided last are platform blocks 80. The platform blocks are provided on the holder. A hook 82 is provided. The hook is co-operable with the pins of the inner cover of the weight-lifting shaft. The hook is adapted to push the pins up when the weight-lifting shaft is properly placed on the holder. In this manner the adjustment knob is allowed to rotate freely.

As may be readily understood from the foregoing, the system of the present invention includes a weight-lifting shaft which has a center and opposed ends. The plurality of cam plates are secured to the weight-lifting shaft adjacent to the opposed ends with their enlarged sections at varying rotational orientations with respect to the weight-lifting shaft. The adjustment knobs are secured to each end of the weight-lifting shaft. In this manner, the rotation of either one of the adjustment knobs will rotate the other one of the adjustment knobs along with the weight-lifting shaft. This will also function to rotate the cam plates with respect to the weights. This, in turn, will releasably and selectively couple the cam plates with the weights as a function of the rotational orientation of the adjustment knobs with respect to the weights.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable dumbbell system comprising:

a plurality of weights, each having a central primary aperture and primary slot, each weight having a major section and an axially offset secondary minor section, the minor section being formed with a secondary aperture and a secondary slot; and a weight-lifting shaft with a plurality of cam plates and an adjustment knob at each end of the shaft, each cam plate being an irregularly shaped polygon with radially enlarged sections providing cam surfaces at maximum radii greater than the radii of the remainder of the cam plate, the radially enlarged sections adapted to releasably couple selectively with the secondary aperture of the weights.

2. The system as set forth in claim 1 wherein the secondary aperture has a radius for the majority of its extent between 30 and 50 percent of the radius of the majority of the extent of the weight.

3. The system as set forth in claim 1 wherein the radius of the maximum radius of the cam plates is between 5 and 10 percent greater than the radius of the remainder of the cam plate.

4. The system as set forth in claim 1 and further including:

a holder with a top and a bottom with sides and hand grooves for safer and more convenient transportation, the holder also having spaced parallel plates for receiving the weights there between and with inverted V-shaped projections adapted to receive a V-shaped recesses of the secondary sections.

5. The system as set forth in claim 1 and further including:

a safety locking assembly allowing a user to turn the adjustment knob when the weight-lifting shaft is properly placed on the holder and to preclude allowing the adjustment knob to turn when the weight-lifting shaft is lifted from the holder, the safety locking assembly including a circular safety locking plate within an inner cover of the weight-lifting shaft and connected to a rotating spindle of the weight-lifting shaft, the safety locking plate having a plurality of lateral pegs spaced at an equal distance from each other around the perimeter of the safety locking plate with spaces between the pegs, the safety locking assembly also including a pin with an associated spring, each spring adapted to urge the pin downwardly, the pin being mounted to a lower portion of each inner cover, each pin having a horizontal protrusion fitting in the spaces between the lateral pegs of the safety locking plate adapted to lock the adjustment knob when the weight-lifting shaft is lifted.

6. The system as set forth in claim 4 and further including:

platform blocks on the holder with a hook co-operable with the pins of an inner cover of the weight-lifting shaft adapted to push the pins up when the weight-lifting shaft is properly placed on the holder thereby allowing the adjustment knob to rotate freely.

7. The system as set forth in claim 1 wherein the weight-lifting shaft has a center and opposed ends and wherein the plurality of cam plates are secured to the weight-lifting shaft adjacent to the opposed ends with their enlarged sections, at varying rotational, orientations with respect to the weight-lifting shaft and wherein the adjustment knobs are secured to each end of the weight-lifting shaft whereby the rotation of either one of the adjustment knobs will rotate the other one of the adjustment knobs along with the weight-lifting shaft as well as the cam plates with respect to the weights to thereby releasably and selectively couple the cam plates to the weights as a function of the rotational orientation of the adjustment knobs with respect to the weights.

8. An adjustable dumbbell system adapted to be self-locked when in use and adjustable when in storage, all in a safe, convenient and economical manner comprising, in combination:

a plurality of weights of varying sizes, each weight having a periphery with a top edge and a bottom edge, each weight formed with a central primary aperture and primary slot, each primary slot having one end passing downwardly to the central aperture and another end extending upwardly to the top edge of the weight to form a gap iii the periphery, the width of each primary slot being equal to the diameter of the central hole, each weight having a major section and an axially offset secondary minor section, the minor section being formed with a secondary aperture on one side and secondary slot extending to the secondary aperture, each secondary aperture having a diameter larger than the diameter of the central aperture, the secondary aperture having a radius for the majority of its extent between 30 and 50 percent of the radius of the majority of the extent of the weight, each secondary slot having a lower end passing downwardly to the secondary aperture and an upper end extending upwardly to the top edge of the weight to form a secondary gap, the width of the secondary slot adjacent to the lower end being less than the diameter of the secondary aperture but larger than the diameter of the central primary aperture, each minor section also including an inverted V-shaped recess below the secondary aperture and extending to the bottom edge;

a weight-lifting shaft with a center and opposed ends, the center having a grip handle and a rotatable spindle extending through the grip handle, a plurality of cam plates with an adjustment knob at each end of the spindle and an inner cover adjacent to each plurality of cam plates opposite to the adjustment knob, and a bridge shaped plate over the top of the cam plates connected to the inner cover and hooked on to the adjustment knob, each cam plate being an irregularly shaped polygon with radially enlarged sections providing cam surfaces at maximum radii greater than the radii of the remainder of the cam plate, the radius of the maximum radius of the cam plates being between 5 and 10 percent greater than the radius of the remainder of the cam plate, the radially enlarged sections adapted to releasably couple selectively with the secondary aperture of the weights, the spindle adapted to fit through the primary slot and couple with the central primary aperture of the weight;

a holder with a top and a ;bottom with sides and hand grooves for safer and more convenient transportation, the holder also having spaced parallel plates for receiving the weights there between and with inverted V-shaped projections adapted to receive the V-shaped recesses of the secondary sections;

a safety locking assembly allowing a user to turn the adjustment knob when the weight-lifting shaft is properly placed on the holder and to preclude allowing the adjustment knob to turn when the weight-lifting shaft is lifted from the holder;

the safety locking assembly including a circular safety locking plate within the inner cover of the weight-lifting shaft and connected to the rotating spindle of the weight-lifting shaft, the safety locking plate having a plurality of lateral pegs spaced at a equal distance from each other around the perimeter of the safety locking plate with spaces between the pegs, the safety locking assembly also including a pin with an associated spring, each spring adapted to urge the pin downwardly, the pin being mounted to a lower portion of each inner cover, each pin having a horizontal protrusion fitting in the spaces between the lateral pegs of the safety locking plate adapted to lock the adjustment knob whew the weight-lifting shaft is lifted; and platform blocks on the holder with a hook co-operable with the pins of the inner cover of the weight-lifting shaft adapted to push the pins up when the weight-lifting shaft is properly placed on the holder thereby allowing the adjustment knob to rotate freely.

* * * * *